US010136721B2

(12) United States Patent
Blanton

(10) Patent No.: US 10,136,721 B2
(45) Date of Patent: Nov. 27, 2018

(54) BAG WITH INTERCHANGEABLE ELEMENTS

(71) Applicant: Tamara Blanton, Washington, DC (US)

(72) Inventor: Tamara Blanton, Washington, DC (US)

( * ) Notice: Subject to any disclaimer, the term of this patent is extended or adjusted under 35 U.S.C. 154(b) by 0 days.

(21) Appl. No.: 15/863,885

(22) Filed: Jan. 6, 2018

(65) Prior Publication Data

US 2018/0153282 A1 Jun. 7, 2018

Related U.S. Application Data

(63) Continuation of application No. 15/444,315, filed on Feb. 27, 2017, now Pat. No. 9,901,161, which is a continuation of application No. 15/068,558, filed on Mar. 12, 2016, now Pat. No. 9,596,921.

(51) Int. Cl.

| | |
|---|---|
| ***A45F 3/04*** | (2006.01) |
| ***A45F 4/12*** | (2006.01) |
| *A42B 1/04* | (2006.01) |
| *A45F 3/00* | (2006.01) |

(52) U.S. Cl.

CPC ..... *A45F 3/04* (2013.01); *A42B 1/041* (2013.01); *A45F 4/12* (2013.01); *A42B 1/048* (2013.01); *A45F 2003/003* (2013.01)

(58) Field of Classification Search

CPC ..... A45F 3/04; A45F 4/12; A45F 2003/003; A42B 1/041; A42B 1/048; A41D 15/04

See application file for complete search history.

(56) References Cited

U.S. PATENT DOCUMENTS

| | | | | |
|---|---|---|---|---|
| 9,635,915 | B2 * | 5/2017 | Salibi | A45C 7/0086 |
| 2010/0078457 | A1 * | 4/2010 | Pitchford | A42B 1/048 224/576 |

* cited by examiner

*Primary Examiner* — Corey Skurdal

(74) *Attorney, Agent, or Firm* — Attentive Law Group, PLLC

(57) ABSTRACT

A bag with interchangeable elements for holding objects includes a detachable front panel, a central hollow compartment, a detachable back panel, a detachable hood, and at least two shoulder straps. The detachable front panel includes a fastening member positioned along a perimeter of the detachable front panel for fastening the detachable front panel to the central hollow compartment. The central hollow compartment accommodates multiple objects, for example, books, etc. The central hollow compartment includes fastening members positioned along opposing perimeters of the central hollow compartment. The detachable back panel includes a fastening member, positioned along a perimeter of the detachable back panel for fastening the detachable back panel to the central hollow compartment. The detachable hood includes at least two fastening members for fastening the detachable hood to the shoulder straps. The shoulder straps are attached to the detachable back panel and include fastening members for removably attaching the detachable hood.

4 Claims, 9 Drawing Sheets

BAG WITH INTERCHANGEABLE ELEMENTS

RELATED PATENT APPLICATION

This application claims priority to U.S. patent application Ser. No. 15/444,315 filed Feb. 27, 2017 which is incorporated herein by reference in its entirety and claims priority to U.S. patent application Ser. No. 15/068,558 filed Mar. 12, 2016, which issued as U.S. Pat. No. 9,596,921 and the content of which is incorporated herein by reference in its entirety.

BACKGROUND OF THE INVENTION

Bags or backpacks are a conventional means used by students to carry study material, such as books, stationery, etc. Younger children do not necessarily treat their bags with extreme care. With prolonged use, the colours and designs provided to the exterior surface of the bag fades away. Sometimes, the internal compartments are still in good condition despite the faded external surfaces. In such cases, the bags are discarded due to the fading away of its external surface colour. This results in unnecessary wastage. A bag with interchangeable external components is required, such that the bag can be reused even after the external surface colour fades away.

Alternatively, the interior compartments of a bag may be damaged due to rough use. Typically, children dump stationery into the compartment of the bag when in a hurry. Some of the objects including stationery may have sharp or pointed edges, for example, steel rulers, compass, dividers, etc. Conventionally, the compartments of the bag are made of fabrics, which are torn, by such sharp or pointed edges of stationery. A newly purchased bag may thus have a damaged internal compartment due to careless use. A bag made of components, which can be replaced, is required. Such a bag would be economically feasible and prevent wastage of the newly purchased bag. A bag with interchangeable internal components is required, such that the bag can be reused after repairing or replacing the damaged internal component.

Traditionally, for students across the world, a book bag or a backpack is a style statement or an expression of the child's individual choice. Students look forward to the back-to-school ritual of purchasing a suitably fashionable bag with more eagerness than starting a new term in school. Conventionally, bags are designed by companies according to their design strategy. A bag having multiple compartments may not be stylishly designed or vice versa. The options available to a child are limited to the designs propagated by established bag manufacturers. Moreover, special edition bags may be released commemorating an incident or an individual. It is not feasible to buy multiple bags for a school-going student based on trending designs. A bag, which can be customised according to the tastes of a child and trending designs, is thus required.

Moreover, conventional book bags or backpacks have a hood for protection from unfavourable weather conditions, for example, excessive rain, cold weather, hot weather, etc. The hood helps cover the head of a user and shields him/her from the aforementioned unfavourable weather conditions. Moreover, conventional hoods are a part of the bag and are non-detachable. The non-detachable hoods prevent usage of trending new designs. Furthermore, detaching hoods from book bags is required when the weather is favourable. The inclusion of detachable hoods enable the user to attach custom designed hoods and add to the style quotient of the book bag. Detachable hoods, which can be changed over time and according to the tastes of a child, is required.

Furthermore, most bags include a foam padded back panel for providing comfort and cushioning the back of a user wearing the bag. In some cases, the foam padding becomes worn out after a period. The internal compartments or the external designs of the bag may be unaffected, but due to the worn out foam padding, the user considers discarding the bag. In such a scenario, a bag that has a detachable back panel that can be independently repaired or replaced is required.

Hence, there is a long felt but unresolved need for a bag with interchangeable external and internal compartments. Moreover, there is a need for a bag with detachable custom designed external components. Furthermore, there is a need for a bag, which is completely detachable such that the damaged or outdated components may be replaced without changing the entire bag. Additionally, there is a need for a detachable hood, which provides protection from unfavourable weather conditions and can be customised depending on the latest trends.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The detachable bag disclosed herein addresses the above mentioned need for a bag which is completely detachable to its individual components such that the damaged or outdated components may be replaced without changing the entire bag. Furthermore, the detachable bag disclosed herein addresses the need for a bag with interchangeable external and internal compartments. Moreover, the detachable bag addresses the need for a bag with detachable custom designed external components. Additionally, the detachable bag addresses the need for a detachable hood, which provides protection from unfavourable weather conditions and can be customised depending on the latest trends. The detachable bag disclosed herein comprises a detachable front panel, a central hollow compartment, a detachable back panel, a detachable hood, and at least two shoulder straps. The detachable front panel comprises a frontal fastening member positioned along a perimeter of the detachable front panel for fastening the detachable front panel to the central hollow compartment. The central hollow compartment is configured to accommodate multiple objects, for example, books, stationery, etc. The central hollow compartment comprises a first fastening member and a second fastening member. The first fastening member is positioned along a perimeter of a first end of the central hollow compartment for fastening the detachable front panel to the central hollow compartment.

The second fastening member is positioned along a perimeter of a second end of the central hollow compartment. The detachable back panel comprises a rear surface and a rear fastening member. The rear fastening member is positioned along a perimeter of the detachable back panel for fastening the detachable back panel to the second end of the central hollow compartment. The detachable hood comprises at least two third fastening members. The shoulder straps are rigidly attached to the rear surface of the detachable back panel and comprise one or more fourth fastening members for removably attaching the detachable hood via the third fastening members.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF THE INVENTION

Figure 1A:
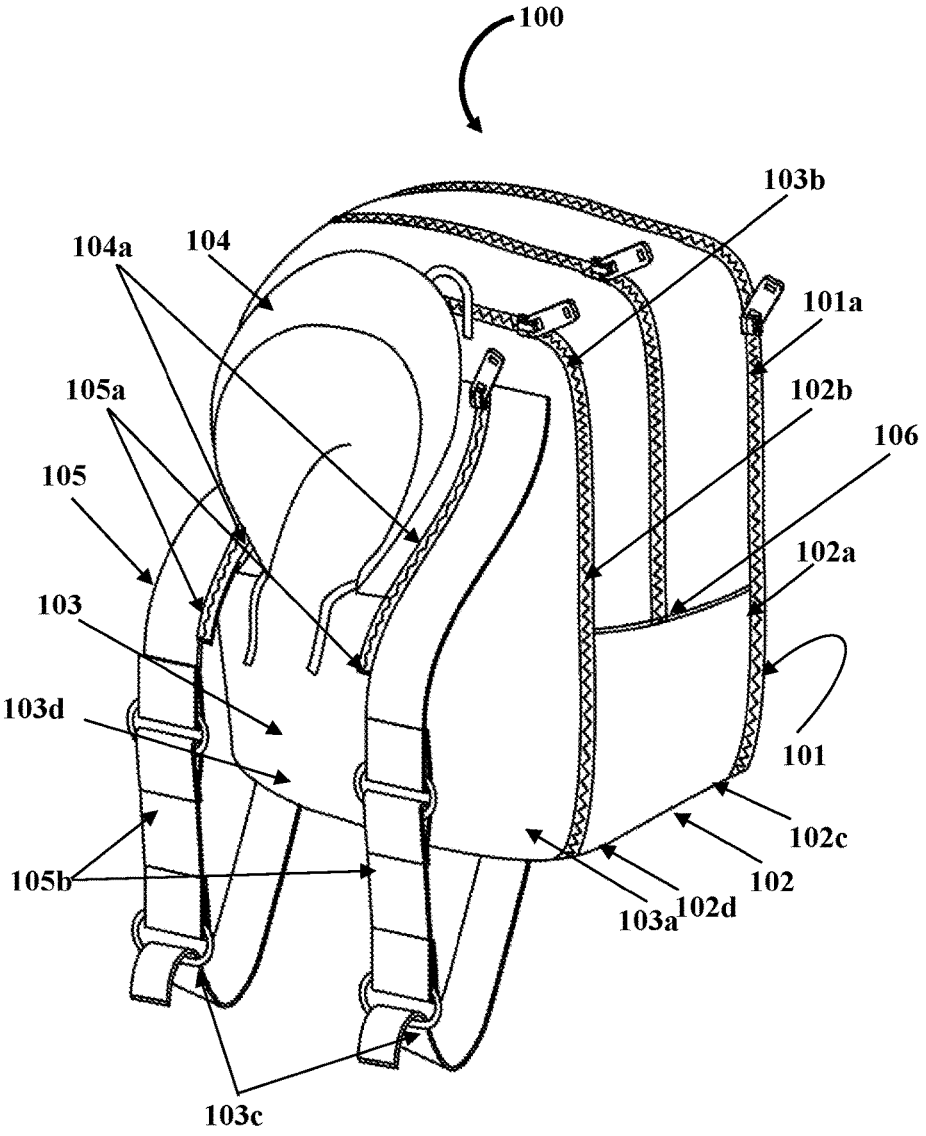
FIG. 1A exemplarily illustrates a perspective view of a detachable bag.

FIG. 1A exemplarily illustrates a perspective view of a detachable bag 100. The detachable bag 100 disclosed herein comprises a detachable front panel 101, a central hollow compartment 102, a detachable back panel 103, a detachable hood 104, and at least two shoulder straps 105. In an embodiment, the detachable bag 100 is made of various fabrics, for example, polyester, nylon rip stop fabric, cotton, cloth, etc. In another embodiment, the detachable bag 100 is made of different materials, for example, polyurethane, leather, etc. The detachable front panel 101 comprises a frontal fastening member 101*a* positioned along a perimeter of the detachable front panel 101. As used herein, "fastening member" refers to a device used to bind the edges of the components of the detachable bag 100. In an embodiment, the fastening members used are zippers. In other embodiments, the fastening members used are, for example, snap fasteners, buttons, clasps, hook and loop fasteners such as Velcro® of Velcro Industries B.V. LLC. The frontal fastening member 101*a* is, for example, a zipper. The frontal fastening member 101*a* fastens the detachable front panel 101 to the central hollow compartment 102. In an embodiment, the detachable front panel 101 comprises an auxiliary fastening member 101*b* exemplarily illustrated in FIGS. 1B-1D. The central hollow compartment 102 is configured to accommodate multiple objects, for example, books, stationery, etc. The central hollow compartment 102 comprises a first fastening member 102*a* and a second fastening member 102*b*.

The first fastening member 102*a* is positioned along a perimeter of a first end 102*c* of the central hollow compartment 102 for fastening the detachable front panel 101 to the central hollow compartment 102. The frontal fastening member 101*a* and the first fastening member 102*a* bind the detachable front panel 101 to the central hollow compartment 102. The second fastening member 102*b* is positioned along a perimeter of a second end 102*d* of the central hollow compartment 102. In an embodiment, the central compartment 102 is accessed by unfastening a central fastening member 102*e* as exemplarily illustrated in FIGS. 1A-1C. The detachable back panel 103 comprises a rear surface 103*a*, a rear fastening member 103*b*, and at least two first attachment members 103*c*. The rear fastening member 103*b* is positioned along a perimeter of the detachable back panel 103 for fastening the detachable back panel 103 to the second end 102*d* of the central hollow compartment 102. Once the detachable front panel 101 and the detachable back panel 103 is attached to the central hollow compartment 102 a hollow space is enclosed in which the objects, for example, notebooks, text books, etc., are placed. The hollow space is accessed primarily by unfastening the detachable front panel 101 partially or completely. The hollow space may also be accessed via the detachable back panel 103.

In an embodiment, the shoulder straps 105 are rigidly attached to the rear surface 103*a* of the detachable back panel 103. Additionally, the first attachment members 103*c* are positioned at a lower end 103*d* of the rear surface 103*a* of the detachable back panel 103. In an embodiment, the detachable bag 100 comprises two shoulder straps 105. By way of example, each of the shoulder straps 105 comprise a fourth fastening member 105*a* and one second attachment member 105*b* as exemplarily illustrated in FIG. 1F. The fourth fastening member 105*a* removably attaches the detachable hood 104 to the shoulder strap 105 rigidly attached to the rear surface 103*a* of the detachable back panel 103. The detachable hood 104 comprises one or more third fastening members 104*a* for fastening the detachable hood 104 to the shoulder straps 105. In an embodiment, the detachable bag 100 comprises side pouches 106 positioned on both sides of the central hollow compartment 102. In another embodiment, the detachable bag 100 further comprises one or more pockets 107 as exemplarily illustrated in FIGS. 1C and 1G. The auxiliary fastening members 101*b* positioned on the detachable front panel 101 of the detachable bag 100 enable attachment of the pocket 107 to the detachable front panel 101 as exemplarily illustrated in FIG. 1C. Moreover, the detachable bag 100 comprises straps 108 for restraining the auxiliary fastening members 101*b* to the detachable front panel 101 as exemplarily illustrated in FIGS. 1B-1D.

Figure 1B:
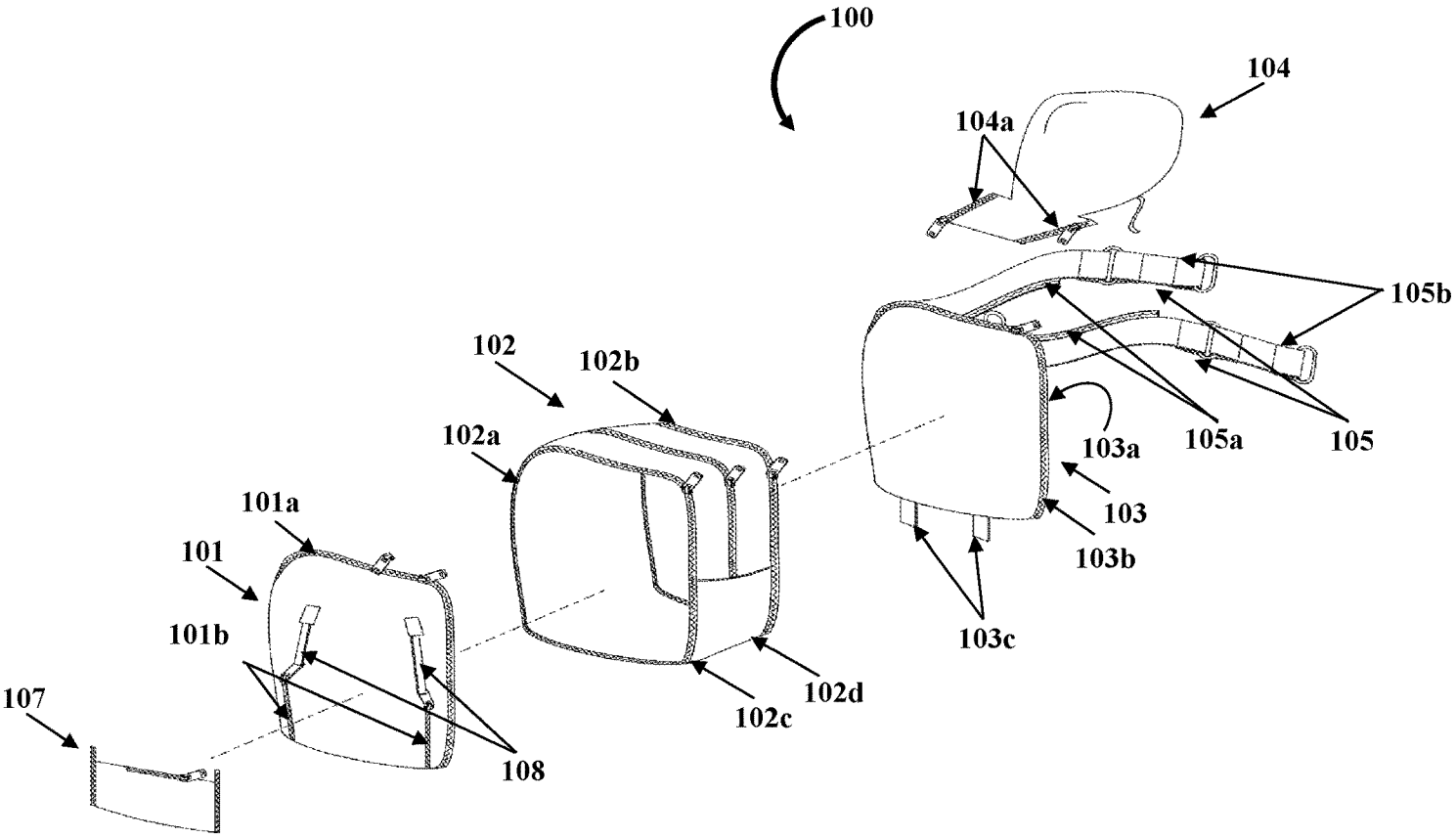
FIG. 1B exemplarily illustrates an exploded view of a detachable bag.

FIG. 1B exemplarily illustrates an exploded view of a detachable bag 100. FIG. 1B exemplarily illustrates the detachable components of the detachable bag 100 disclosed in the detailed description of FIG. 1A. As the components of the detachable bag 100 can be detached as exemplarily illustrated in FIG. 1B, the components may be stored without requiring additional space in a travel bag or a suitcase. In the case of a non-detachable bag, the non-detachable bag will require space and prevent a user from adding other required equipment or clothing when the user travels.

Figure 1C:
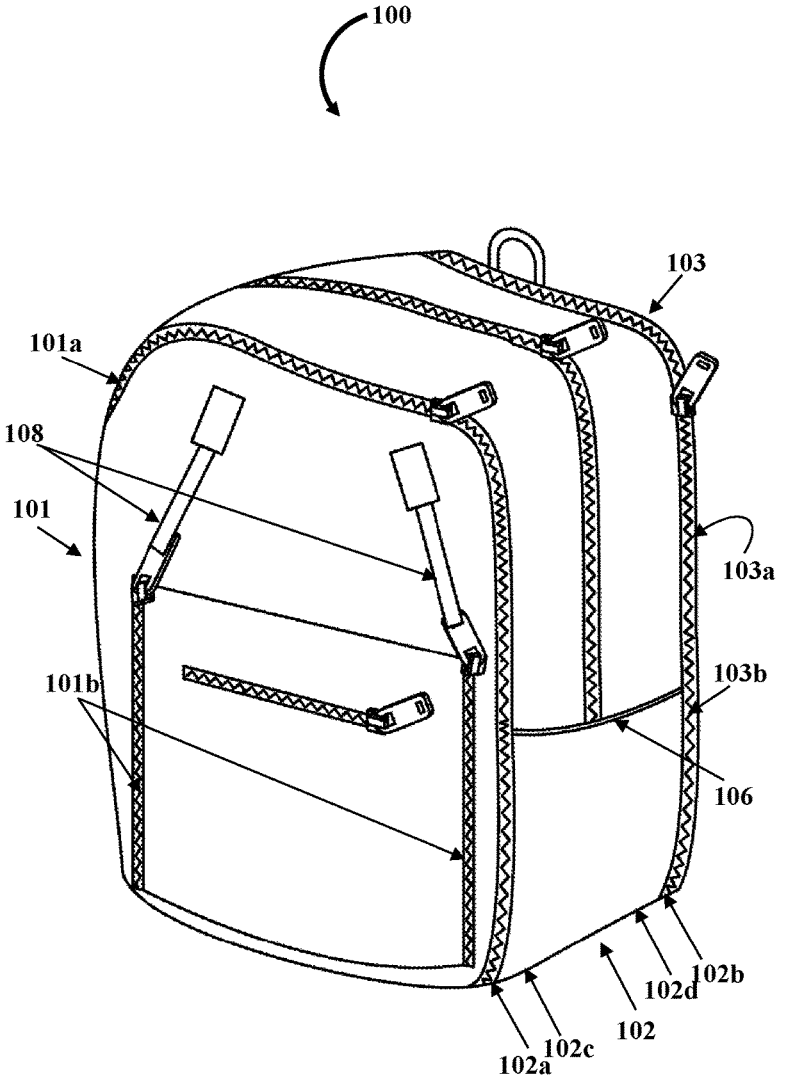
FIG. 1C exemplarily illustrates an assembled view of a detachable bag showing the detachable front panel, the central hollow compartment, and the detachable back panel assembled together.

FIG. 1C exemplarily illustrates an assembled view of a detachable bag 100 showing the detachable front panel 101, the central hollow compartment 102, and the detachable back panel 103 assembled together. In an embodiment, the detachable front panel 101 is fastened to a first end 102*c* of the central hollow compartment 102 using the first fastening member 102*a* and the frontal fastening member 101*a*. A pocket 107 is fastened to the detachable front panel 101 using multiple auxiliary fastening members 101*b* exemplarily illustrated in FIG. 1A. The auxiliary fastening members 101*b* are restrained by the straps 108. A detachable back panel 103 is attached to a second end 102*d* of the central hollow compartment 102 using a second fastening member 102*b* and a rear fastening member 103*b* as exemplarily illustrated in FIG. 1C. The detachable hood 104 is attached to the shoulder straps 105 using the third fastening members 104*a* and each of the fourth fastening members 105*a* as exemplarily illustrated in FIG. 1A. In an embodiment, the detachable bag 100 comprises side pouches 106. The side pouches 106 hold various objects, for example, water bottles, stationery, etc.

Figure 1D:
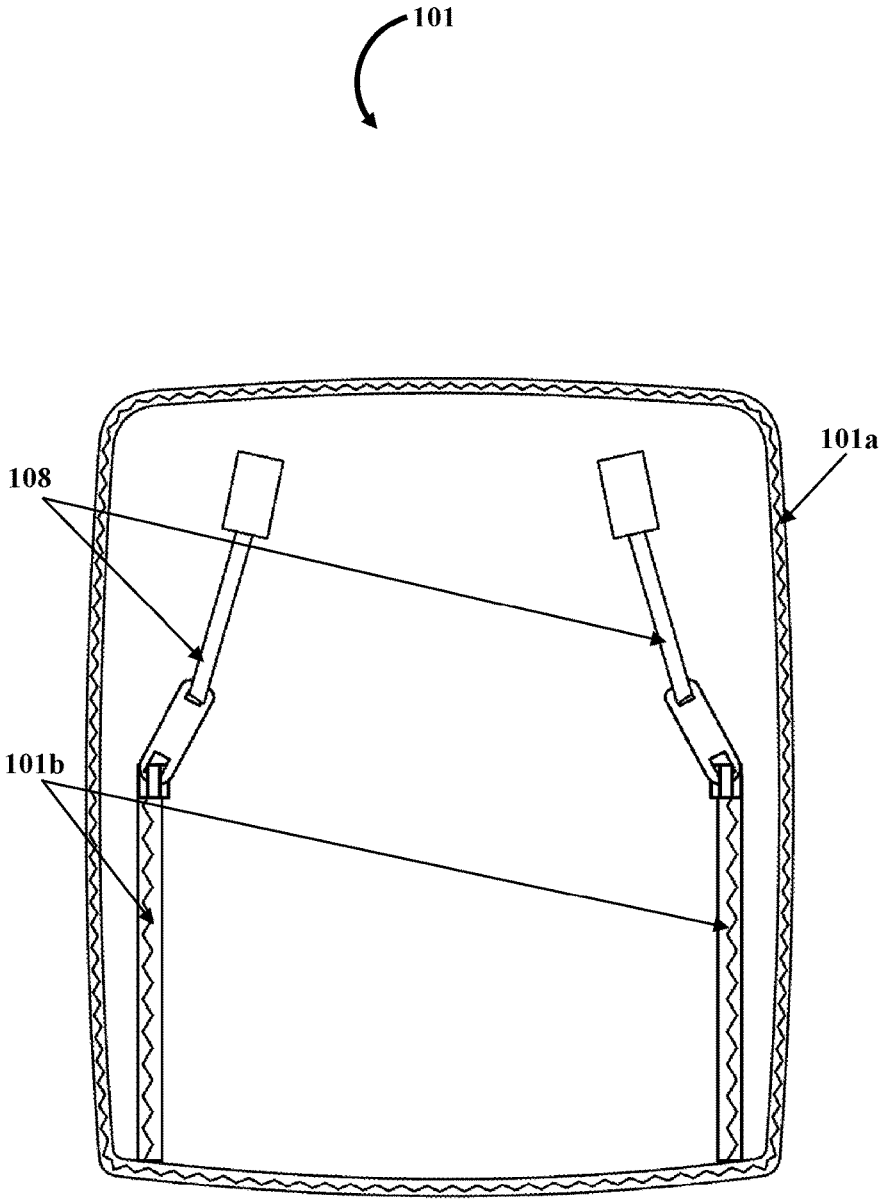
FIG. 1D exemplarily illustrates a front elevation view of a detachable front panel of a detachable bag.

FIG. 1D exemplarily illustrates a front elevation view of a detachable front panel 101 of a detachable bag 100. In an embodiment, the detachable front panel 101 comprises an auxiliary fastening member 101*b* for attaching a pocket 107 as exemplarily illustrated in FIG. 1C. In another embodiment, the detachable front panel 101 comprises multiple pockets 107 of varying shapes and sizes. In another embodiment, the detachable front panel 101 comprises images, for example, superhero images, celebrity images, ethnic designs, etc., inscribed on the detachable front panel 101.

Figure 1E:
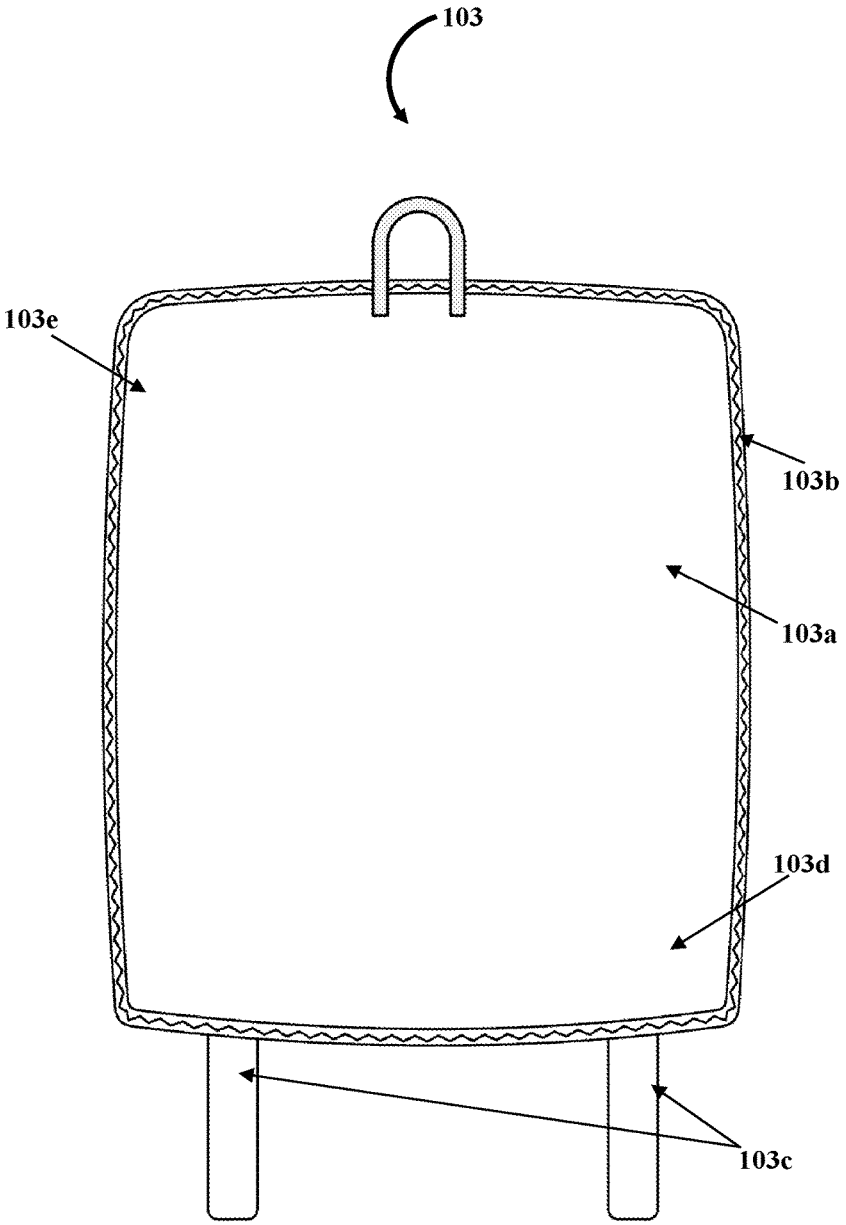
FIG. 1E exemplarily illustrates a rear elevation view of a detachable back panel of a detachable bag.

FIG. 1E exemplarily illustrates a rear elevation view of a detachable back panel 103 of a detachable bag 100. In an embodiment, the detachable back panel 103 is foam padded to provide a cushioning effect to the back of a user. The detachable back panel 103 is designed to affect the user's balance minimally. Consider the example of a worn out detachable back panel 103. As the foam padding of the detachable back panel 103 has lost its effectiveness, the user feels discomfort when his/her back comes into contact with the rear surface 103*a* of the detachable back panel 103. In such a scenario, the detachable back panel 103 alone is removed and replaced with a new detachable back panel 103, which has an effective foam padding. This results in reusability of the detachable bag 100, and prevents wastage due to a defect in one component of the detachable bag 100. The shoulder straps 105 extend from an upper end 103*e* to a lower end 103*d* of the detachable back panel 103. The shoulder straps 105 are rigidly attached at the upper end 103*e* and attached via the first attachment member 103*c* positioned at the lower end 103*d* of the detachable back panel 103 as exemplarily illustrated in FIG. 1A.

Figure 1F:
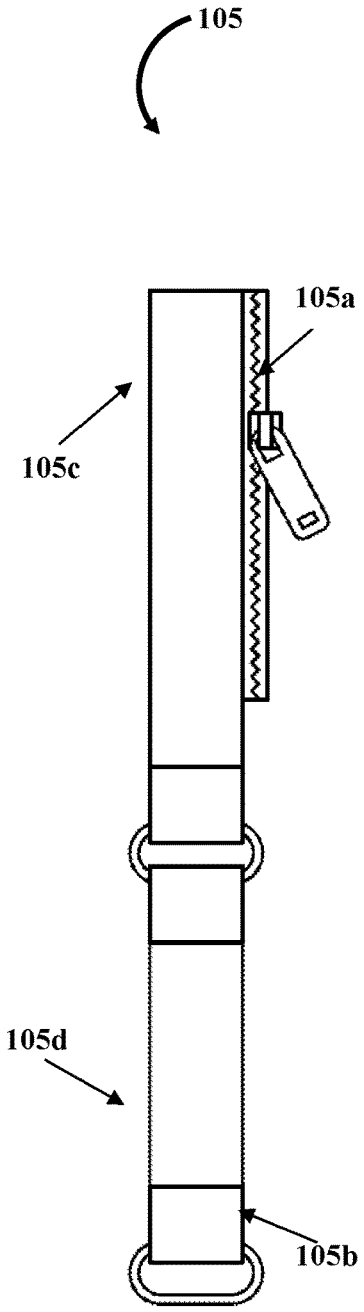
FIG. 1F exemplarily illustrates a front elevation view of a shoulder strap of a detachable bag.

FIG. 1F exemplarily illustrates a front view of a shoulder strap 105 of a detachable bag 100. The shoulder strap 105 comprises a fourth fastening member 105*a*. The shoulder strap 105 enables a user to strap the detachable bag 100 to his/her shoulder, thereby providing better mobility than a bag held by hand. The fourth fastening member 105*a* is positioned at an upper end 105*c* of the shoulder strap 105. The third fastening member 104*a* of the detachable hood 104 and the fourth fastening member 105*a* enable attachment of the detachable hood 104 to the upper end 105*c* of the shoulder strap 105. Moreover, the second attachment member 105*b* is positioned at a lower end 105*d* of the shoulder straps 105. The first attachment member 103*c* and the second attachment member 105*b* enable attachment of the rear surface 103*a* of the detachable back panel 103 to the lower end 105*d* of the shoulder strap 105. The second attachment member 105*b* also allows adjustment of the shoulder straps 105 depending on the user's choice.

Figure 1G:
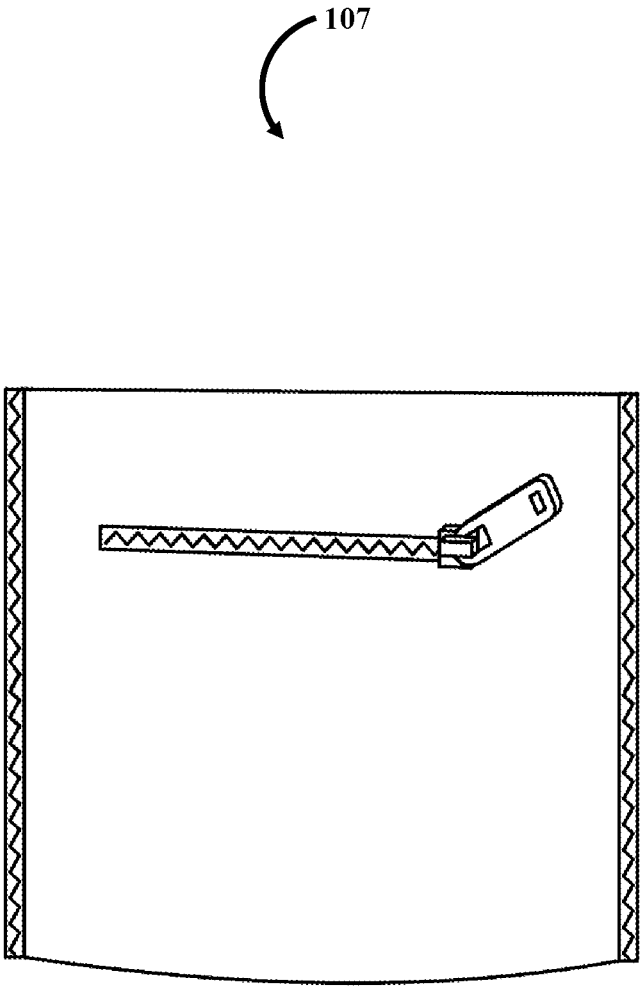
FIG. 1G exemplarily illustrates a front elevation view of a detachable pocket of a detachable bag.

FIG. 1G exemplarily illustrates a front view of a pocket 107 of a detachable bag 100. In an embodiment, the detachable front panel 101 comprises multiple pockets 107 for holding objects, for example, pens, pencils, erasers, pencil leads, etc.

Figure 1H:
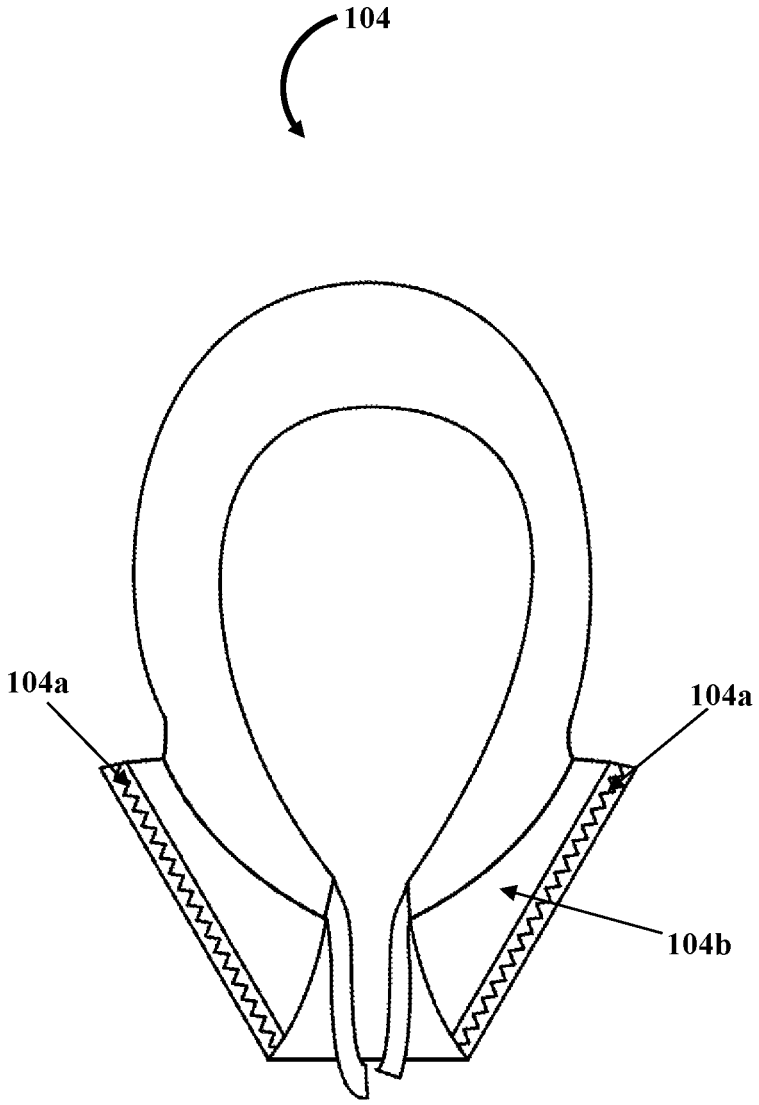
FIG. 1H exemplarily illustrates a front elevation view of a detachable hood of a detachable bag.
Figure 1I:
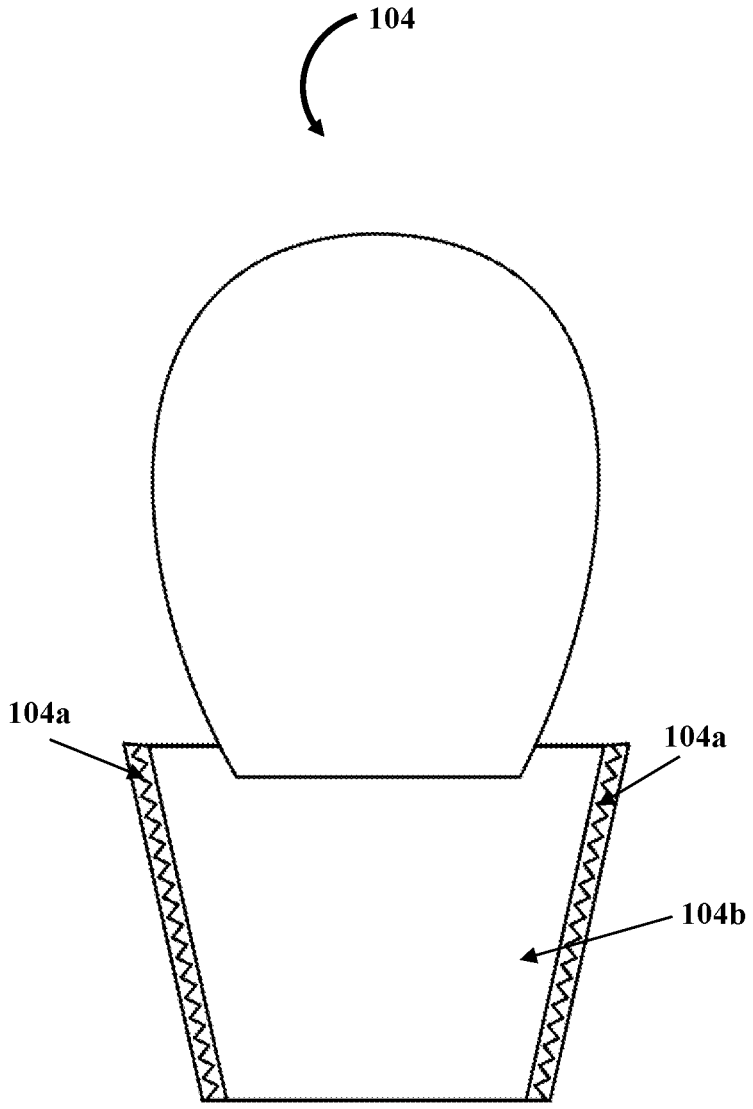
FIG. 1I exemplarily illustrates a rear elevation view of a detachable hood of a detachable bag.

FIGS. 1H-1I exemplarily illustrate a front elevation view and a rear elevation view of a detachable hood 104 of a detachable bag 100 respectively. In an embodiment, the detachable hood 104 comprises one third fastening member 104*a*. In another embodiment, the detachable hood 104 comprises two third fastening members 104*a* as exemplarily illustrated in FIGS. 1H-1I. The detachable hood 104 attaches to the shoulder straps 105 using the fourth fastening members 105*a* and the two third fastening members 104*a* as disclosed in the detailed description of FIG. 1F. Additionally, the detachable hood 104 comprises a yoke 104*b*. As used herein, a yoke refers to a shaped pattern piece, which forms a part of the detachable hood 104, usually extending around the neck and shoulders. The yoke 104*b* is sewn onto the detachable hood 104. The yoke 104*b* provides added support to the neck and shoulders of a user and reduces the stress experienced by the user's neck and shoulders. The absence of the yoke 104*b* places additional strain as the weight of the detachable bag 100 is transferred directly to the detachable hood 104. In an embodiment, the detachable hood 104 provided are of different colours and fabrics. The fabric options provided depend on the current weather cycle. If the weather is rainy, the detachable hood 104 would be water resistant and prevent water from seeping through to the head of the user. If the weather is cold and dry, the detachable hood 104 has multiple layers made of, for example, wool, warm materials, etc.

The foregoing examples have been provided merely for the purpose of explanation and are in no way to be construed as limiting of the detachable bag 100, and the kit disclosed herein. While the detachable bag 100 and the kit have been described with reference to various embodiments, it is understood that the words, which have been used herein, are words of description and illustration, rather than words of limitation. Further, although the detachable bag 100, and the kit have been described herein with reference to particular means, materials, and embodiments, the detachable bag 100 and the kit are not intended to be limited to the particulars disclosed herein; rather, the detachable bag 100 and the kit extend to all functionally equivalent structures, methods and uses, such as are within the scope of the appended claims. Those skilled in the art, having the benefit of the teachings of this specification, may effect numerous modifications thereto and changes may be made without departing from the scope and spirit of the detachable bag 100 and the kit disclosed herein in their aspects.

I claim:

1. A bag for holding objects comprising:

a front panel with an outer perimeter connected to an outer perimeter of a front side of a central panel;

a back panel with an outer perimeter connected to an outer perimeter of a back side of the central panel;

wherein the front panel, central panel, and back panel when connected form a first central hollow compartment configured to accommodate a plurality of objects;

the central panel can be removed with the front panel outer perimeter connected to the back panel outer perimeter to create a second central hollow compartment and the bag includes a first should strap and a second shoulder strap, the first shoulder strap having a first should strap fastening member located along an upper portion for connecting to a first hood fastening member of a removable hood and the second should strap having a second shoulder strap fastening member for connecting to a second hood fastening member of the removable hood.

2. The bag of claim 1, wherein the front panel, the back panel, and the central panel are of one or more fabrics.

3. The bag of claim 1, wherein the front panel, the back panel, and the central panel form a backpack which further comprises an opening for accessing the first central hollow compartment.

4. The bag of claim 1, wherein the first shoulder strap fastening member is located along a first upper portion of the first should strap running longitudinally along a first portion of a first interior seem of the first should strap; and the second shoulder strap fastening member is located along a second upper portion of the second should strap running longitudinally along a second portion of a second interior seem, the first shoulder strap fastening member and the second should strap fastening member facing each other in a relatively parallel arrangement.

* * * * *